US006538549B1

(12) United States Patent
Renne et al.

(10) Patent No.: US 6,538,549 B1
(45) Date of Patent: Mar. 25, 2003

(54) ADVANCED ELECTRICAL CIRCUIT BREAKER SYSTEM AND METHOD

(75) Inventors: Scott W. Renne, Bellingham, WA (US); Kevin L. Lacy, Bellingham, WA (US); Porter Hoagland, Jr., West Mystic, CT (US)

(73) Assignee: Blue Sea Systems, Bellingham, WA (US)

( * ) Notice: Subject to any disclaimer, the term of this patent is extended or adjusted under 35 U.S.C. 154(b) by 0 days.

(21) Appl. No.: 09/944,945

(22) Filed: Aug. 30, 2001

(51) Int. Cl.[7] ..... H01H 71/16; H01H 71/12

(52) U.S. Cl. ..... 337/64; 337/36; 337/37; 337/51; 337/55

(58) Field of Search ..... 337/298, 14, 36, 337/37, 51, 55, 56, 64, 85, 112, 113, 333, 334, 353, 369; 200/6 R, 6 B, 19.03, 19.13, 19.2, 416, 428, 431, 564, 568, 573

(56) References Cited

U.S. PATENT DOCUMENTS

| | | | | |
|---|---|---|---|---|
| 2,415,473 A | | 2/1947 | Dougherty | 200/138 |
| 2,476,648 A | | 7/1949 | Zeller | 200/116 |
| 2,507,949 A | | 5/1950 | Asder | 200/116 |
| 2,513,564 A | | 7/1950 | Ingwersen | 200/116 |
| 2,558,908 A | | 7/1951 | Paige | 200/116 |
| 2,660,643 A | | 11/1953 | Toth | 200/116 |
| 2,743,333 A | | 4/1956 | Epstein | 200/138 |
| 2,757,258 A | | 7/1956 | Jorgensen | 200/116 |
| 2,774,844 A | | 12/1956 | Buck et al. | 200/116 |
| 3,087,146 A | | 4/1963 | Boudouris | 340/332 |
| 3,141,941 A | | 7/1964 | Dew | 200/116 |
| 3,187,145 A | | 6/1965 | Grabinski | 200/113 |
| 3,265,832 A | | 8/1966 | Powell | 200/116 |
| 3,311,725 A | | 3/1967 | Butler et al. | 200/138 |
| 3,321,596 A | | 5/1967 | Delafrange | 200/116 |
| 3,573,701 A | * | 4/1971 | Graham et al. | 337/378 |
| 3,668,594 A | * | 6/1972 | Kulick | 337/380 |
| 3,670,284 A | * | 6/1972 | Fortier et al. | 337/360 |
| 3,728,658 A | * | 4/1973 | Kasahara | 337/90 |
| 3,771,087 A | | 11/1973 | Riendeau | 337/112 |
| 3,778,739 A | | 12/1973 | Burch | 337/72 |
| 3,832,667 A | | 8/1974 | Blanton | 337/354 |
| 3,848,211 A | | 11/1974 | Russell | 337/64 |
| 3,873,955 A | | 3/1975 | Bauer | 337/72 |
| 3,878,498 A | * | 4/1975 | Allen et al. | 337/347 |
| 3,928,833 A | | 12/1975 | McClellan | 337/56 |
| 3,932,830 A | * | 1/1976 | Holtkamp | 337/64 |
| 3,949,344 A | * | 4/1976 | Hancock et al. | 337/347 |
| 4,023,131 A | | 5/1977 | Seiden | 337/67 |
| 4,319,214 A | | 3/1982 | Givler | 337/343 |

(List continued on next page.)

FOREIGN PATENT DOCUMENTS

GB 2315160 A * 1/1998 ..... H01H/37/12

*Primary Examiner*—Anatoly Vortman
(74) *Attorney, Agent, or Firm*—Brian L. Johnson; George C. Rondeau, Jr.; Davis Wright Tremaine LLP

(57) ABSTRACT

An advanced circuit breaker system and method includes first and second terminals to electrically couple the advanced circuit breaker to an electrical circuit. A cam applies a first torque to a rotatable contact arm, having an arm contact electrically coupled to the first terminal, from a first position to a second position of the contact arm and a second torque to the contact arm from the second position to a third position. A bimetal blade, having a blade contact electrically coupled to the second terminal, changes shape when electrical current flowing through it exceeds a threshold for at least a predetermined amount of time. The arm contact maintains contact with the blade contact when the first torque occurs and separates from the blade contact when the second torque occurs. The blade contact changes shape to increase separation from the arm contact if electrical current exceeds at least a certain amount above the threshold.

34 Claims, 7 Drawing Sheets

U.S. PATENT DOCUMENTS

| | | | | | |
|---|---|---|---|---|---|
| 4,471,338 | A | * | 9/1984 | Holtkamp | 337/64 |
| 4,500,863 | A | * | 2/1985 | Sepulveda | 337/70 |
| 4,573,031 | A | | 2/1986 | Krasser | 337/68 |
| 4,682,138 | A | | 7/1987 | Sell | 337/68 |
| 4,704,595 | A | * | 11/1987 | Essig et al. | 337/107 |
| 4,939,495 | A | * | 7/1990 | Peterson et al. | 337/79 |
| 4,993,144 | A | * | 2/1991 | Llewellyn et al. | 29/622 |
| 5,004,994 | A | | 4/1991 | Korczynski et al. | 337/66 |
| 5,012,495 | A | | 4/1991 | Munroe et al. | 337/3 |
| 5,021,761 | A | | 6/1991 | Stack et al. | 337/68 |
| D321,339 | S | | 11/1991 | Stack et al. | D13/160 |
| D322,960 | S | | 1/1992 | Stack et al. | D13/160 |
| D357,669 | S | | 4/1995 | Stack et al. | D13/178 |
| 5,694,106 | A | | 12/1997 | Wang | 337/79 |
| 5,877,670 | A | * | 3/1999 | Sehlhorst et al. | 337/302 |

* cited by examiner

ADVANCED ELECTRICAL CIRCUIT BREAKER SYSTEM AND METHOD

TECHNICAL FIELD

The invention relates generally to protection equipment for electrical circuits, and more particularly to electrical circuit breakers.

BACKGROUND OF THE INVENTION

A circuit protector device, such as a fuse or circuit breaker, protects an electrical circuit from damage due to over-current and short-circuit conditions. An overcurrent condition occurs when there is too high a level of electrical current flowing in an electrical circuit due to power demand of circuit loads being greater than the design capacity of the electrical circuit. A short-circuit condition occurs when an electrically conductive member makes contact with two points of an electrical circuit causing electrical current to bypass the circuit's electrical load resulting in extremely high electrical currents. Over-current and short-circuit conditions can damage conductor wires of electrical circuits due to overheating of the conductor wires and result in burning of the wire insulation. Other damage caused by over-current and short-circuit conditions may result with the electrical or electronic equipment found in a particular electrical circuit. In a protected electrical circuit, when an over-current or short-circuit condition occurs, the circuit protector device acts as an open electrical switch thereby preventing additional electrical current from flowing in the protected electrical circuit.

Fuses protect electrical circuits by using a "fusible link" that melts to cause an open circuit condition when the amount of electrical current flowing through the protected electrical circuit exceeds a known level. Circuit breakers use thermal or magnetic based mechanisms that are sensitive to the amount of electrical current flowing through a protected electrical circuit. These thermal and magnetic based mechanisms also cause an open switch condition when electrical current exceeds a known level. Circuit breakers become progressively more expensive, relative to fuses, for applications where the operational level of electrical current is very high. Generally, fuses are less expensive, however, circuit breakers are much more convenient than fuses since they can be reused whereas fuses must be replaced.

Some challenging applications of circuit breakers involve environments having at least one of the following conditions: high temperature, high humidity, and inherent vibrational forces. The marine environment has these characteristics. Circuit breakers generally have many components that increase the cost of their manufacture. Further, these many components must perform reliably both as individual components and as a collective unit. Given the convenience of circuit breakers compared to fuses, there is much motivation for improving circuit breakers to further extend their scope of application and reduce their cost of manufacture while maintaining and increasing their reliability and performance characteristics.

SUMMARY OF THE INVENTION

The present invention resides in a method and system for an advanced circuit breaker including a housing, first and second electrical terminals, a contact arm, a cam up, a torque generating member, and a bimetal blade. The first and second electrical terminals are affixed to the housing and are configured to electrically couple the electrical circuit breaker to the electrical circuit. The contact arm includes first and second portions.

The first portion of the contact arm is electrically coupled to the first terminal and some aspects included being rotatably mounted within the housing. The second portion of the contact arm has an arm contact affixed and electrically coupled thereto.

Some aspects included the cam having first and second portions wherein the first portion is rotatably mounted within the housing. In some aspects, the second portion is movably coupled to the contact arm such that rotation of the cam in a first rotational direction through a first amount of rotation causes rotation of the contact arm in a second rotational direction and further rotation of the cam in the first rotational direction through a second amount of rotation beyond the first amount of rotation causes rotation of the contact arm in a direction counter to the second rotational direction. In some aspects, the torque generating member is configured to apply a torque to the cam tending to rotate the cam in the first rotational direction.

In some aspects, the bimetal blade is electrical coupled to the second electrical terminal and is configured to change shape based upon an amount of electrical current above a threshold level passing through the bimetal blade for at least a predetermined amount of time. The bimetal blade has a blade contact affixed and electrically coupled thereto. The bimetal blade is shaped and positioned with respect to the contact arm such that the blade contact contacts the arm contact to prevent the contact arm from rotating in the second rotational direction when the amount of electrical current flowing through the bimetal blade is below the threshold level. Further aspects included the bimetal blade being shaped and positioned with respect to the contact arm to allow the contact arm to rotate in the second rotational direction with the cam rotating in the first rotational direction through the first amount of rotation and to allow the contact arm to remain in contact with the blade contact when the amount of electrical current flowing through the bimetal blade increasingly exceeds the threshold level by up to a first amount of electrical current for at least at predetermined amount of time.

Other aspects include the electrical circuit breaker further comprising a conductive shaft electrically coupled to the first terminal and wherein the first portion of the contact arm is electrically coupled to the first terminal through the conductive shaft. Alternative aspects include the electrical circuit breaker having a camshaft rotatably mounted within the housing and wherein the cam is fixedly attached to the camshaft.

Other aspects include the bimetal blade being further shaped and positioned with respect to the contact arm such that when the amount of electrical current flowing through the bimetal blade exceeds the first amount, the blade changes shape and position with respect to the contact arm to cause the blade contact to stop contacting the arm contact and thereby allow the contact arm to rotate counter to the second rotational direction with the cam rotating in the first rotational direction through the second amount of rotation beyond the first amount of rotation.

Other aspects include the electrical circuit breaker further comprising a breaker throw lever fixedly attached to the cam such that a torque applied to the breaker throw lever opposite and exceeding the torque applied to the cam will prevent the contact arm from rotating when the bimetal blade changes shape and position with respect to the contact arm as the electrical current through the bimetal blade exceeds the threshold level for at least a predetermined amount of time. Further aspects include the contact arm having first and second contact arm rails extending longitudinally away from the first portion of the contact arm and substantially parallel to one another. Each of the first and second contact arm rails having a contact arm slot extending longitudinally within and having a cam slidably retained thereto to movably connect the cam to the contact arm.

Other aspects include the cam having first and second cam arms extending longitudinally away from the first portion of the cam and substantially parallel to one another. The first and second cam arms have a pin coupled thereto and extending therebetween and a roller so mounted on the pin to rollably engage the contact arm.

Other aspects include the bimetal blade configured and positioned to change shape and position with respect to the contact arm based upon the amount of electrical current passing through the bimetal blade above the threshold level and independent from rotational position of the cam. Further aspects include the bimetal blade being a snap disc or having the shape of a Valverde blade. Further aspects include the contact arm being sized and positioned with respect to the bimetal blade such that the arm contact maintains substantial contact with a blade contact without electrical arcing occurring between the arm contact and the blade contact as the bimetal blade changes shape and position with respect to the contact arm and as the cam rotates through the first amount of rotation.

Other aspects include the electrical circuit breaker having a conductive shaft electrically coupled to the first terminal and wherein the first portion of the contact arm is electrically and rotatably coupled to the conductive shaft. Further aspects include the electrical circuit breaker having an electrically conductive bearing lubricated with electrically conductive lubricant and configured to electrically and rotatably couple the first portion of the contact arm to the conductive shaft. Other aspects include the torque generating member being a spring shaped and positioned to apply a torque to the cam in the first rotational direction. Other aspects include the electrical circuit breaker having a camshaft having the cam rotatably mounted thereto and wherein the spring is coupled to the cam. Other aspects include a camshaft being coupled to the housing and wherein the cam is rotatably mounted on the camshaft.

Other aspects include the breaker throw lever being fixedly attached to the camshaft such that the position of the breaker throw lever indicates whether the arm contact and the blade contact are in contact with one another. Other aspects include the housing having a housing cover which includes an opening with the camshaft projecting therethrough and beyond an exterior surface of the housing cover and configured for attachment of the breaker throw lever thereto and also having a seal positioned with respect to the camshaft, the breaker throw lever, and the opening of the housing cover to prevent fluids from entering into an internal containment area of the housing from areas adjacent to the external surface of the housing cover.

Other aspects include a current sensitive structure electrically coupled to the second electrical terminal configured to change shape based upon amount of electrical current above the threshold level passing through the current sensitive structure for at least a predetermined amount of time. Other aspects include a linkage coupled to the contact arm configured to apply rotational torque to the contact arm tending to rotate the contact arm in a rotational direction from the first position with contact arm to the second position the contact arm.

Other features and advantages of the invention will become apparent from the following detailed description, taken in conjunction with the accompanying drawings.

DETAILED DESCRIPTION OF THE INVENTION

Figure 1:
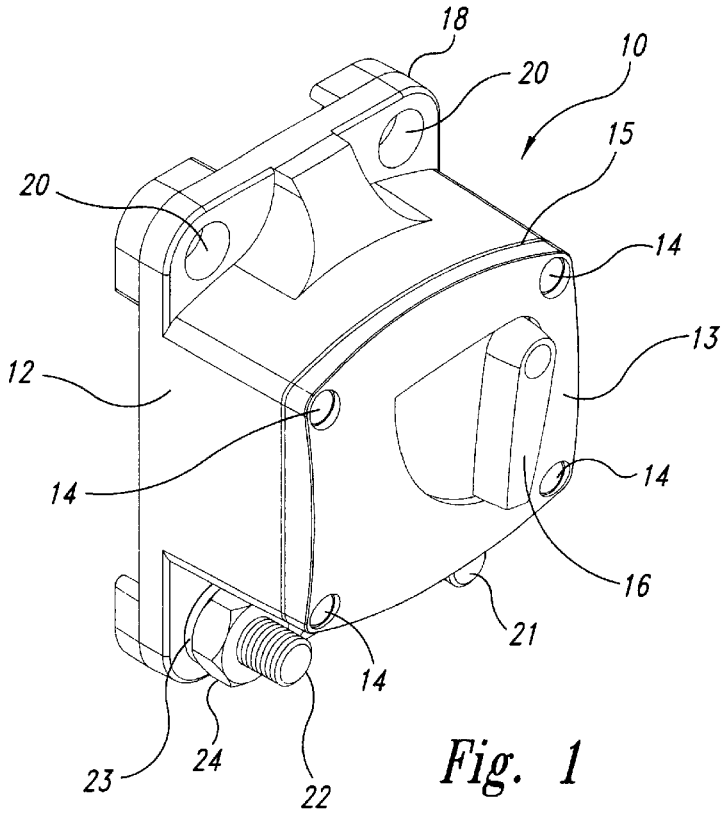
FIG. 1 is an isometric view of an advanced electrical breaker comprising one embodiment of the invention.

Embodiments of an advanced thermal based electrical circuit breaker system and method are described. As shown in the drawings for purposes of illustration, the present invention is embodied in an advanced circuit breaker 10 to serve as a circuit protection device for an electrical circuit. The advanced circuit breaker 10 has a breaker housing 12 and a housing cover 13 affixed to the breaker housing with rivets 14. A cover gasket 15 is positioned between the breaker housing 12 and the housing cover 13 to prevent moisture from entering into the breaker housing. In some embodiments, the breaker housing is made of a thermoset polyester material, but other embodiments use other non-conductive materials known in the art.

The advanced circuit breaker 10 further includes a breaker throw lever 16 to indicate status of the advanced circuit breaker and to be used as a switch lever to move components internal to the breaker housing 12 as further described below. The embodiment of the advanced circuit breaker 10 depicted in FIG. 1 is configured for mounting on a wall or other surface. Other embodiments are configured for mounting within panel type fixtures or are configured for other mounting arrangements. A mounting bracket 18 with bracket mounting holes 20 allows for wall-type mounting of the advanced circuit breaker 10. A first electrical terminal 21 and a second electrical terminal 22, each having electrical terminal compression washers 23 and an electrical terminal nut 24, are used to electrically coupled the advanced circuit breaker 10 to a protected circuit (not shown).

Figure 2:
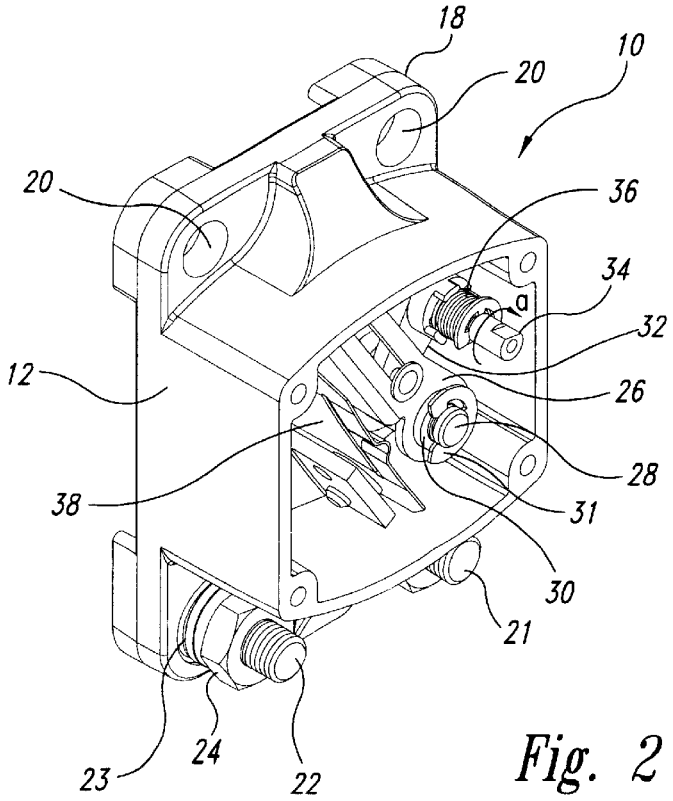
FIG. 2 is an isometric view of the advanced circuit breaker of FIG. 1 with its housing cover removed.

Components internal to the breaker housing 12 are shown in FIG. 2. The advanced circuit breaker 10 has a contact arm 26 rotatably coupled to an electrically conductive shaft 28 by a conductive bearing 30. The conductive bearing 30 is lubricated with a conducting material such as a mixture of grease and finely powdered silver or other powdered electrically conducting material. Furthermore, the conductive shaft 28 is electrically coupled to the first electrical terminal 21. Complications found with conventional circuit breakers regarding electrical coupling of contact arms with electrical terminals, such as involving so-called pigtail connections, are thus avoided. The contact arm 26 and the conductive bearing 30 are secured in position with means such as a conductive shaft C-clip 31, aptly shaped walls of the breaker housing 12, or other configurations. In other embodiments, the contact arm 26 is affixed to the conductive shaft 28 and the conductive shaft is electrically and rotatably coupled to the first electrical terminal 21.

The advanced circuit breaker 10 has a cam 32 fixedly coupled to a camshaft 34 and positioned to receive a biasing torque, indicated by Arrow "a", from a biasing spring 36 or other torque generating member. When the advanced circuit breaker 10 is fully assembled, the breaker throw lever 16 is attached to the camshaft 34 allowing the breaker throw lever to indicate the status of the rotational position of the camshaft and also permitting manual rotational movement of the camshaft by movement of the breaker throw lever. The breaker throw lever 16 serves many purposes, which will be further elucidated by the discussion below. In short, the breaker throw lever 16 serves by indicating operational status of the advanced circuit breaker 10, by acting as an electrical switch throw lever for the advanced circuit breaker during periods of normal operation without over-current or short-circuit conditions, and by acting as a reset lever to reset the advanced circuit breaker after being tripped by an over-current or short-circuit condition. As discussed further below, the contact arm 26 is coupled to the cam 32 such that the cam serves as a linkage whereby movement of the camshaft 34 causes movement of the contact arm 26.

A bimetal blade 38, being a current sensitive structure, is electrically coupled to the second electrical terminal 22. The bimetal blade 38 has two metal layers with differing thermal expansion properties such that the bimetal blade has a first configuration, typically being flat, when at temperatures below a threshold temperature and a second configuration, which progressively bends in a continuous fashion away from the first configuration as temperature of the bimetal blade rises farther above the threshold temperature and stays above the threshold temperature for at least a predetermined amount of time until typically the bimetal blade reaches a snapping position and snaps to change shape in a discontinuously buckling, snapping fashion to quickly move away from and clear of the contact arm. For instance, for an exemplary embodiment, for a current at above 135% of the amperage rating, the exemplary embodiment would trip after at least one hour and for a current rating above 200% of the amperage rating, the exemplary embodiment would trip after at least 2 minutes. According to conventional knowledge regarding circuit breakers, the bimetal blade 38 is fashioned with respect to a particular threshold temperature so chosen for particular amperage ratings based on amount of current and duration of time in which the amount of current occurs. The bimetal blade 38 is positioned adjacent to the contact arm 26 such that as the temperature of the bimetal blade rises farther above the threshold temperature and stays above the threshold temperature for at least a predetermined amount of time, the bimetal blade progressively bends in a continuous fashion farther away from the contact arm 26, until the bimetal blade reaches the snapping position to subsequently snap. The advanced circuit breaker 10 can employ many varieties of bimetal snap blades or bimetal snap discs of appropriate dimensions and material, which will respond with progressive continuous bending and culminate in a discontinuously buckling, snapping motion away from the contact arm 26 as a result of heating due to a predetermined level of electrical current occurring for a given duration of time. Magnitude of current above a predetermined level governs the duration of time required for the bimetal blade 38 to snap resulting in tripping of the advanced circuit breaker 10. This conveniently provides a mechanical analog of the thermal condition of the protected device, such as a motor or other electrical device. In the illustrated embodiment, a valverde shape is used for the bimetal blade 38.

Figure 3:
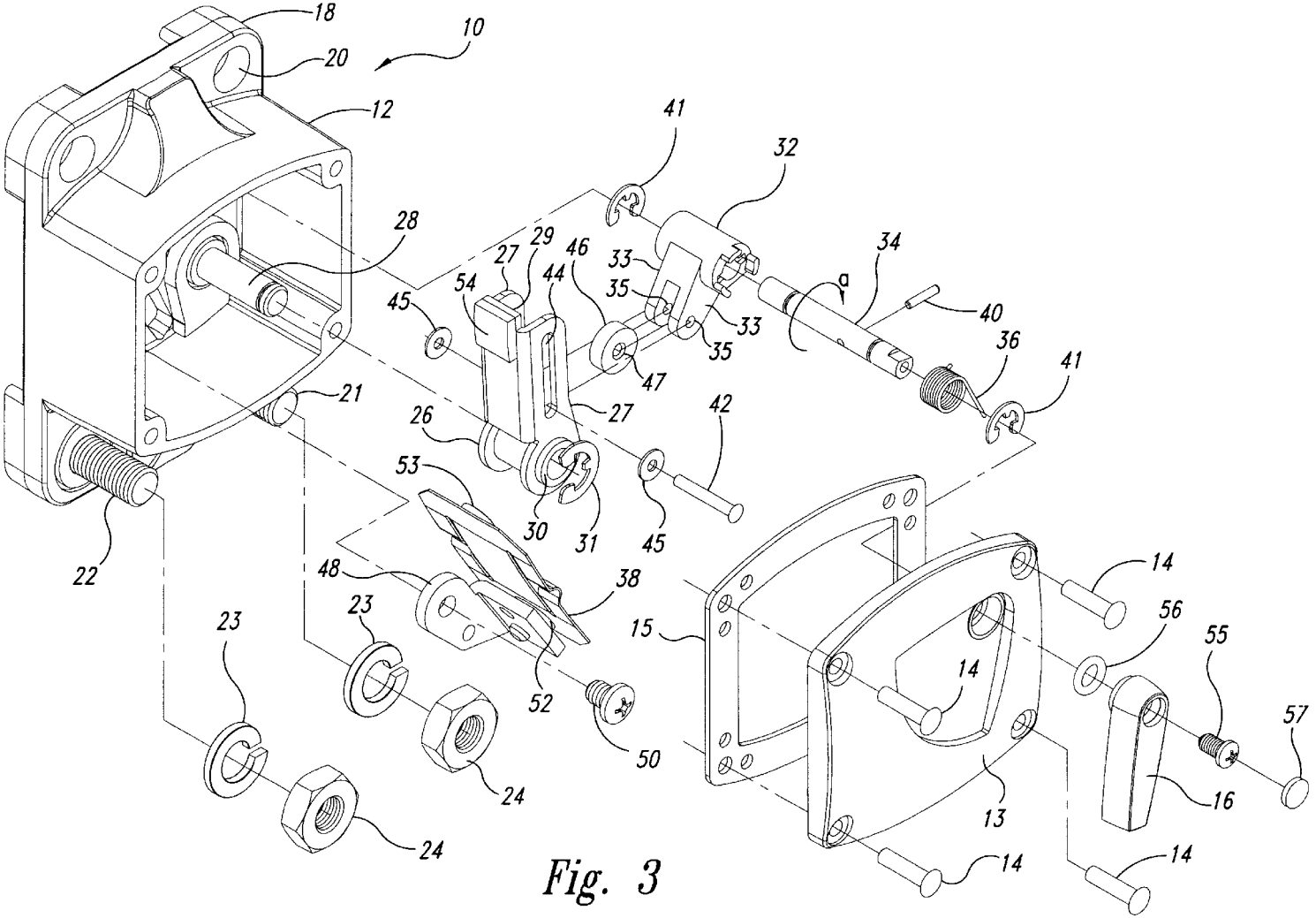
FIG. 3 is an exploded isometric view of the advanced circuit breaker of FIG. 1.

An exploded view of the advanced circuit breaker 10 showing the components internal to the breaker housing 12 is provided in FIG. 3. As shown, the cam 32 is secured to the camshaft 34 for rotation therewith by a camshaft pin 40, which prevents rotational movement of the cam with respect to the camshaft. C-clip washers 41 prevent the cam 32 from sliding longitudinally along the camshaft and prevent the cam from coming off the camshaft.

The contact arm 26 further includes two elongated contact arm rails 27 each having a longitudinally extending rail slot 44. Each contact arm rail 27 has an internal surface facing the internal surface of the other contact arm rail. Each of the contact arm rails also has an external surface that is opposite its internal surface. Extending longitudinally between the contact arm rails 27 and affixed thereto is a contact arm wall 29 with an elongated internal smooth walled surface facing toward the cam 32.

The cam 32 includes two cam rails or arms 33, each having a cam arm hole 35. The cam arms 33 have internal surfaces facing one another and each of the cam arms has an external surface that is opposite its internal surface.

The cam arms 33 extend toward and terminate with the cam arm holes 35 positioned between the contact arm rails 27. The distal ends of the cam arms 33 are movably retained by the contact arm 26 by a cam rivet or axle 42, which extend through the rail slots 44 and the cam arm holes 35. Cam rivet washers 45 are positioned on the cam axle 42 adjacent each of the external surfaces of the contact arm rails 27. The cam 32 is positioned and sized relative to the contact arm 26 such that the external surface of each of the cam arms 33 is adjacent one of the internal surfaces of the contact arm rails 27. A roller 46 having a center hole 47 is positioned between the cam arms 33 and rotatably mounted on the cam axle 42. The cam axle 42 is slidably retained in the rail slots 44 with the roller 46 rotatably engaging the internal surface of the contact arm wall 29 to be movably retained by the contact arm 26

The bimetal blade 38 includes a blade bracket 48 used to secure the bimetal blade 38 to the breaker housing 12 with a blade screw 50, and includes a blade spacer 52 used to adjust the bimetal blade. The bimetal blade 38 further includes a blade contact 53 shaped and positioned on the bimetal blade to contact an arm contact 54 on the contact arm wall 29 of the contact arm 26 when the advanced circuit breaker 10 is in its fully closed position, thereby allowing current to flow in its associated protected electrical circuit.

The breaker throw lever 16 is attached to the camshaft 34 by a throw lever screw 55. A throw lever gasket 56 serves to seal the breaker throw lever 16 to prevent moisture from entering the breaker housing 12. A throw lever screw cover 57 protects the throw lever screw 55.

Figure 4B:
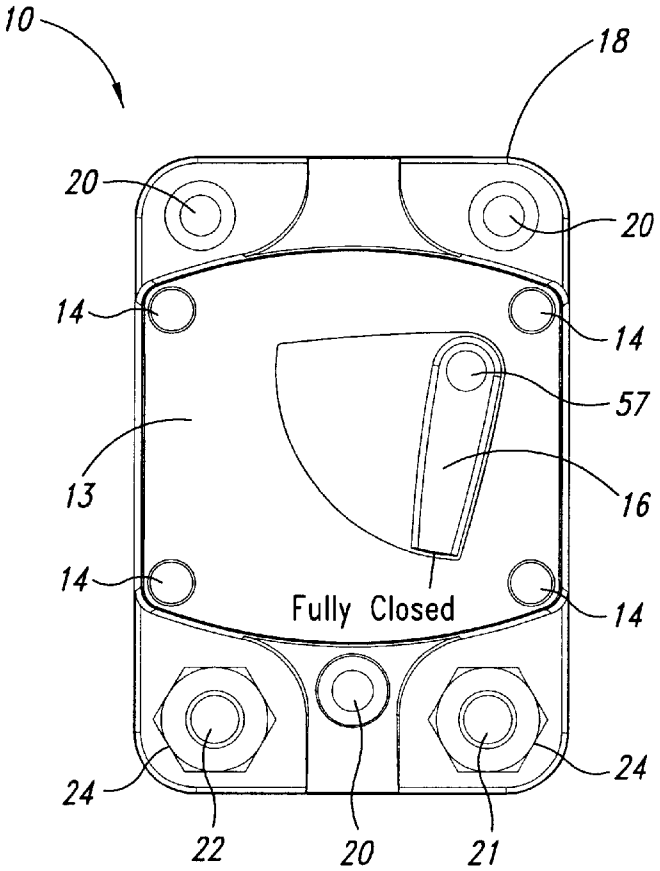
FIGS. 4A and 4B are schematic diagrams of the advanced circuit breaker as shown in FIG. 2 with and without housing cover, respectively, in fully closed position.
Figure 4A:
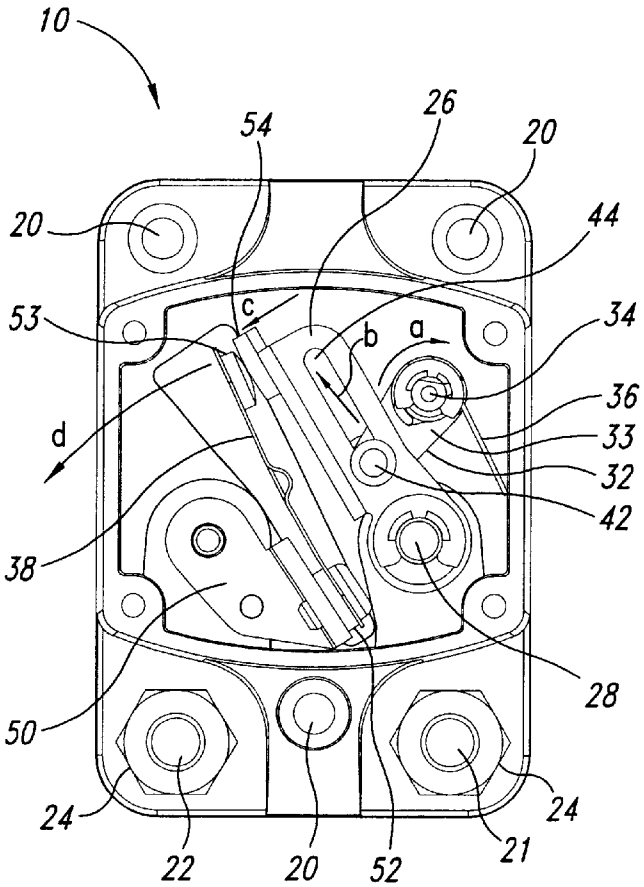

The advanced circuit breaker 10 uses the biasing torque, indicated by the Arrow "a", of the biasing spring 36, to keep the blade contact 53 and the arm contact 54 either together in electrical contact or separated apart depending upon the rotational position of the cam 32. In the fully closed position of the advanced circuit breaker 10, as shown in FIGS. 4A and 4B, the biasing torque of the biasing spring 36 causes a force, indicated by Arrow "b", to be applied by the cam arms 33 through the roller 46 to the contact arm 26, thereby causing a force, indicated by Arrow "c", to be applied by the arm contact 54 on the blade contact 53. The bimetal blade 38 is pre-tensioned such that in the fully closed position of the advanced circuit breaker 10 the bimetal blade causes a force to be applied by the blade contact 53 on the arm contact 54 in a direction opposite to that indicated by the Arrow "c." As long as the blade contact 53 remains stationary, the contact arm 26 will remain stationary and in turn, the cam 32 will remain locked in a stationary fully closed position. This locking action has potential in reducing false triggering found with conventional circuit breakers.

When an over-current or short-circuit condition occurs, the bimetal blade 38 will begin to trip from the fully closed position of the advanced circuit breaker 10 to its fully open position by bending toward the direction indicated by Arrow "d" thereby allowing the camshaft 34 to rotate clockwise in the direction of the biasing torque indicated by Arrow "a". As the camshaft 34 begins from the fully closed position of the advanced circuit breaker 10 to rotate in the direction of the biasing torque indicated by Arrow "a", the roller 46 will continue to apply a force against the contact arm 26 resulting in a force continuing to be applied by the arm contact 54 against the blade contact 53, generally in the direction indicated by the Arrow "c". This continual force being applied by the arm contact 54 against the blade contact 53, through an enhanced "wiping motion", reduces or eliminates unwanted contact arcing, contact chatter, and contact creep found with tripping motion or gradually increased load current of a conventional circuit breaker. The continual force being applied by the arm contact 54 against the blade contact 53 serves to maintain contact forces between the arm contact and the blade contact during the gradual continuous bending motion of the bimetal blade 38 toward the fully open position and also for a certain extent of motion by the contact blade after it has snapped to change shape as explained further below.

Figure 5B:
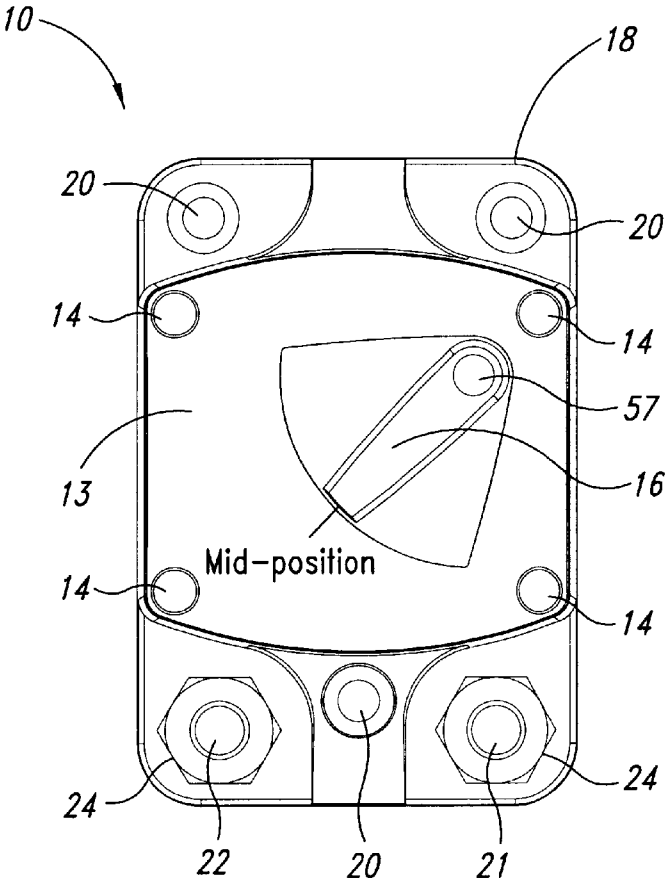
FIGS. 5A and 5B are schematic diagrams of the advanced circuit breaker as shown in FIG. 2 with and without housing cover, respectively, in mid-position.
Figure 5A:
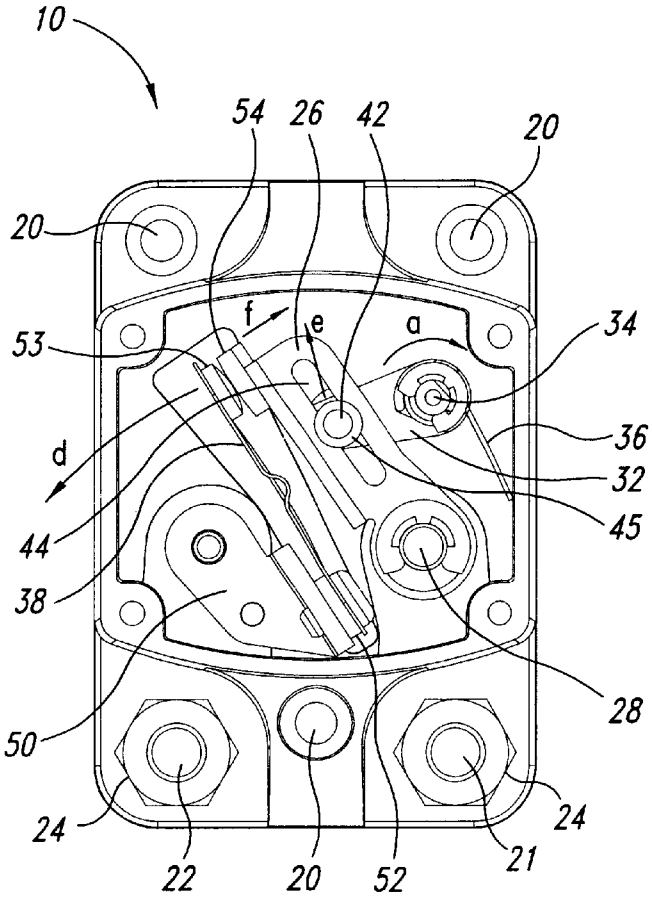
Figure 6B:
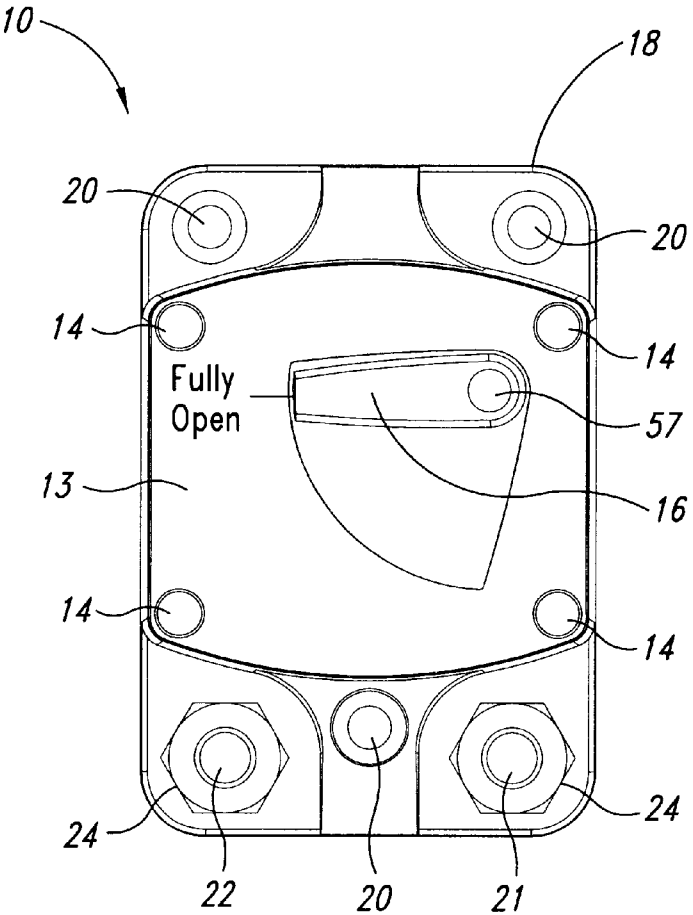
FIGS. 6A and 6B are schematic diagrams of the advanced circuit breaker as shown in FIG. 2 with and without housing cover, respectively, in fully open position.
Figure 6A:
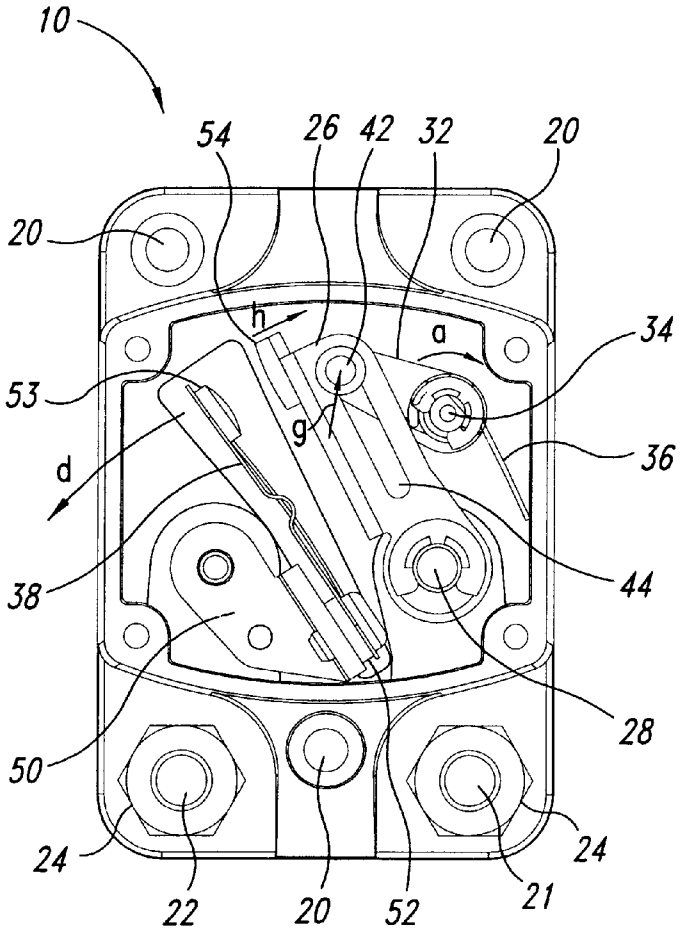

As the bimetal blade 38 continues to bend even further toward the direction indicated by the Arrow "d", and after the bimetal blade has snapped to change shape, the cam 32 and the contact arm 26 will reach a mid-position, as shown in FIGS. 5A and 5B. When moving from the fully closed position, just before reaching this mid-position, the arm contact 54 will no longer exert a force in the direction indicated by Arrow "c" in FIG. 4A. Due to snapping of the bimetal blade 38, the cam 32 and the contact arm 26 will then rapidly reach the mid-position whereby a force indicated by Arrow "e" is applied by the cam axle 42 on to the contact arm 26 causing a force to be applied on to the arm contact 54 in a direction generally indicated by Arrow "f" away from the blade contact 53. Once the cam 32 and the contact arm 26 move into this mid-position, the camshaft 34 will continue to rotate rapidly in the clockwise direction of the Arrow "a" until the cam 32 and the contact arm 26 reach its fully open position, as shown in FIGS. 6A and 6B. In the fully open position, the blade contact 53 and the arm contact 54 are fully separated from each other due to the bending of the snapped bimetal blade 38 in the direction generally indicated by the Arrow "d" and also due to the biasing torque causing a force indicated by the Arrow "g" to be applied by the cam axle 42 on to the contact arm 26 resulting in a force on the arm contact 54 in the direction generally indicated by Arrow "h".

Figure 7B:
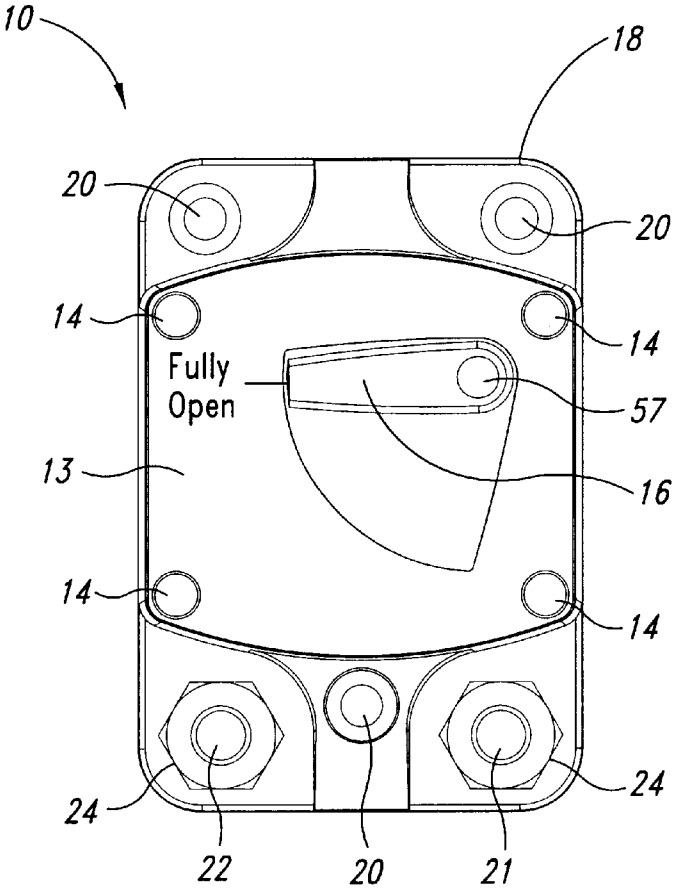
FIGS. 7A and 7B are schematic diagrams of the advanced circuit breaker as shown in FIG. 2 with and without housing cover, respectively, in fully open position of the contact arm and the fully closed position of the bimetal blade.
Figure 7A:
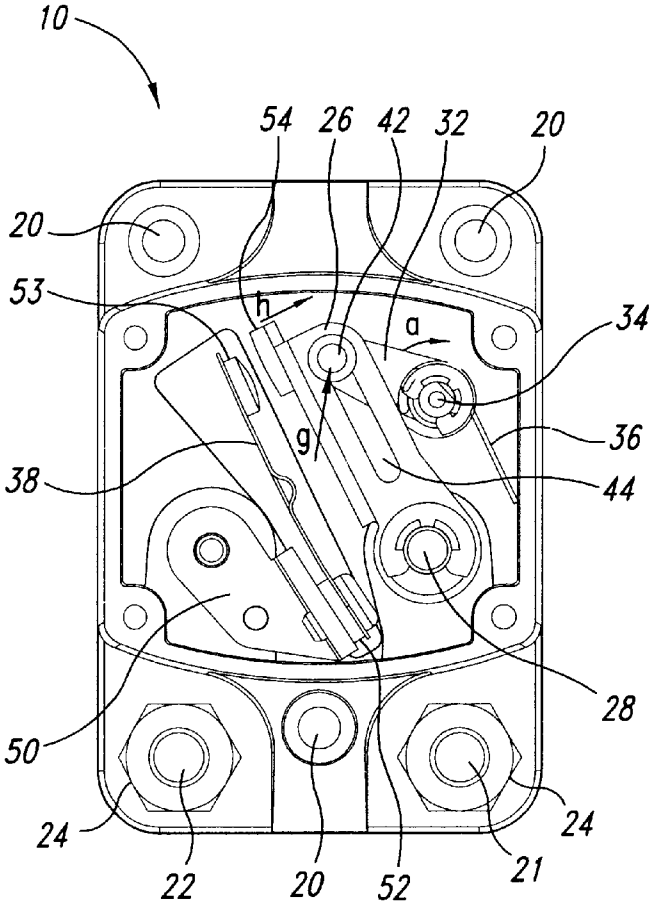

This movement of the cam 32 and the contact arm 26 from the mid-position to the fully open position occurs regardless of whether the bimetal blade 38 continues to be bent in its snapped condition and in the direction generally indicated by the Arrow "d". Generally during over-current or short-circuit conditions of the associated electrical circuit protected by the advanced circuit breaker, the bimetal blade 38 will continue to be bent in its snapped condition in the direction generally indicated by the Arrow "d". After an overcurrent or short-circuit condition has occurred and the bimetal blade 38 has cooled to return to its fully closed position, the contact arm 26 will remain in its fully open position, as shown in FIGS. 7A and 7B, until the advanced circuit breaker 10 is reset.

In summary, two independent mechanical actions are involved in separation of the blade contact 53 from the arm contact 54, which enhances reliability and performance of the advanced circuit breaker 10. Bending forces causing a gradual continuous first motion and a rapid discontinuously buckling, snapping second motion of the bimetallic blade 38 causes movement of the blade contact 53 in the direction generally indicated by the Arrow "d" and the biasing torque indicated by the Arrow "a" causes movement of the arm contact 54 in the direction generally indicated by the Arrows "f" and "h". With the advanced circuit breaker 10, separation distance between the blade contact and the arm contact can potentially be increased relative to conventional circuit breakers contacts because both the blade contact and the arm contact of the advanced circuit breaker move in opposite directions when the advanced circuit breaker is tripped to the fully open position due to an over-current or short-circuit condition. This bi-directional movement of the blade contact 53 and the arm contact 54 may also help to potentially reduce the number of false triggers compared with conventional circuit breakers.

The advanced circuit breaker 10 can also be used as a manual switch in which a clockwise torque is applied to the breaker throw lever 16 to open the advanced circuit breaker from the fully closed position to the fully open position. The advanced circuit breaker 10 can be manually switched to the fully open position, even when the bimetal blade 38 is cool enough to be in the position shown in FIG. 4A, if enough clockwise torque is applied to the breaker throw lever 16 to bend the bimetal blade in the direction indicated by the Arrow "d" as the breaker throw lever rotates from the fully closed position to the mid-position. Once the breaker throw lever 16 is moved just past the mid-position, the biasing torque indicated by the Arrow "a" will continue to move the breaker throw lever to the fully open position and since the bimetal blade 38 is cool, it will move back to its fully closed position.

To reset the advanced circuit breaker 10, counterclockwise torque is typically applied by hand to the breaker throw lever 16 to move the breaker throw lever from the fully open position to the fully closed position by overcoming the biasing torque indicated by the Arrow "a". If the bimetal blade 38 has cooled down from an elevated temperature caused by an over-current or short-circuit condition, additional torque is typically applied by hand to the breaker throw lever to flex the bimetal blade in the direction generally indicated by the Arrow "d" to move the breaker throw lever 16 from the fully open position to just past the mid-position in the direction of the fully closed position. In moving the breaker throw lever 38 past the mid-position to the fully closed position, the cooled bimetal blade 38 will return to its unflexed position in the general direction opposite of the Arrow "d" so less torque will typically be needed to be applied to the breaker throw lever 16 to move the breaker throw lever past the mid-position to the fully closed position.

Figure 8B:
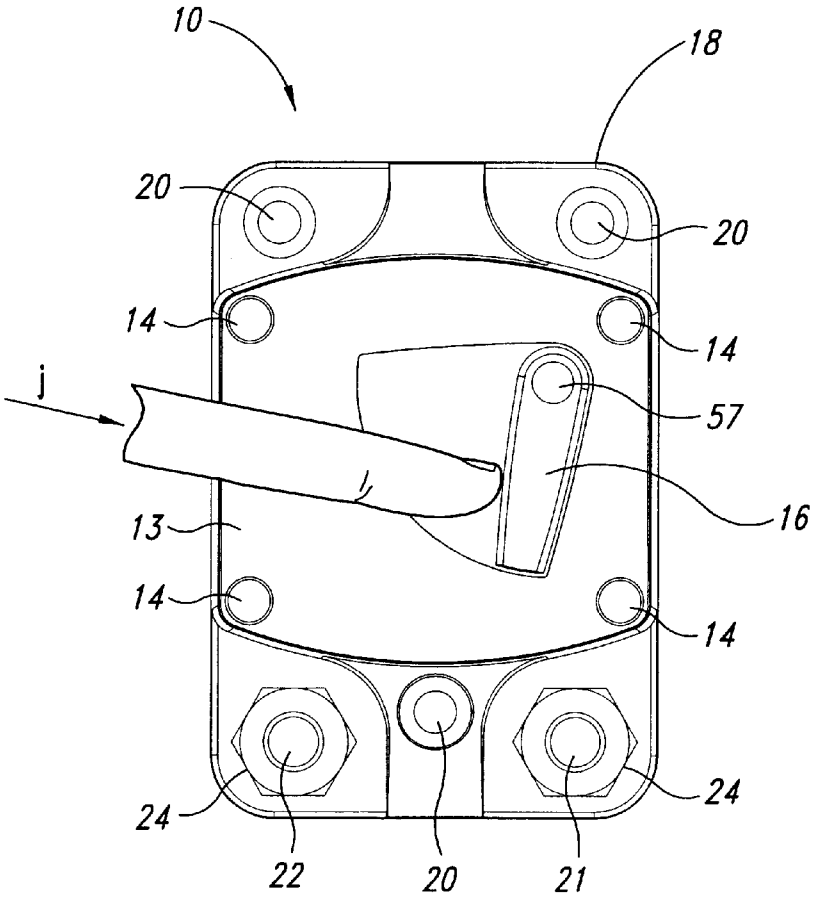
FIGS. 8A and 8B are schematic diagrams of the advanced circuit breaker as shown in FIGS. 1 and 2, respectively, illustrating an inherent safety feature to protect against accidental premature resetting of the circuit breaker.
Figure 8A:
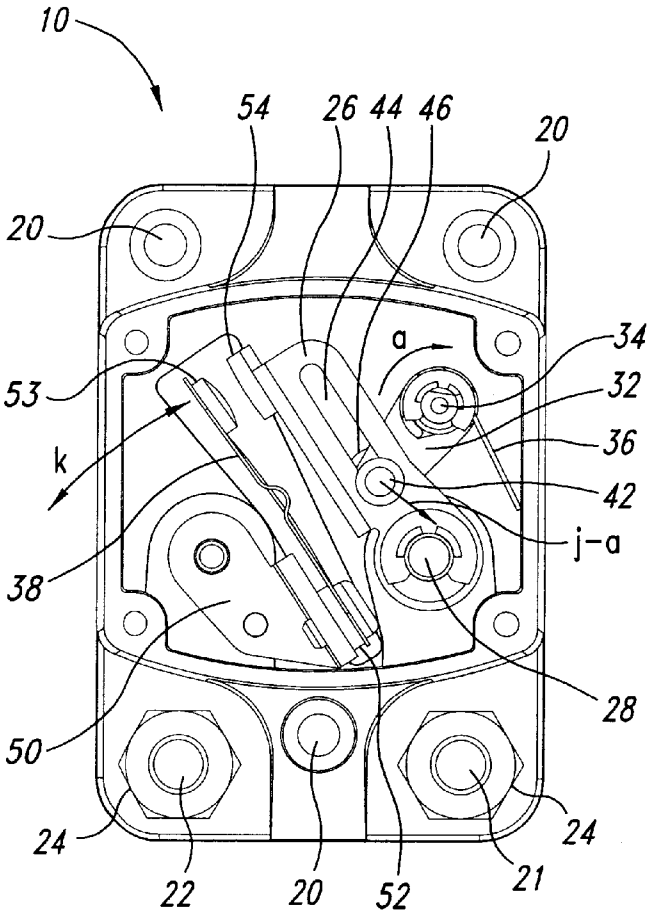

If an attempt is made to reset the advanced circuit breaker 10 before an over-current or short-circuit condition has ended by applying a force "j" to the breaker throw lever 16, as shown in FIGS. 8A and 8B, the cam 32 and the contact arm 26 will manually be returned to their fully closed position while the bimetal blade 38 cycles between its fully open and its fully closed positions as indicated by movement arrow "k". During the cycling of the bimetal blade 38 between its fully open and its fully closed positions, the bimetal blade first cools down from an elevated temperature caused by an over-current or short-circuit condition to flatten out and go from its fully open position to its fully closed position. Brief contact will then occur between the blade contact 53 and the arm contact 54 causing an elevation in temperature of the bimetal blade due to the overcurrent or short-circuit condition and subsequent bending of the bimetal blade away from its fully closed position and return to its fully open position. The duration of time that the bimetal blade will remain in its fully closed position with contact of the blade and arm contacts 53 and 54 during this cycling behavior is inversely proportional to the level of excess current caused by the over-current or short-circuit condition occurring in the circuit. Thus, the advanced circuit breaker 10 has an inherent redundant safety feature that will continue to protect an electrical circuit even though an operator mistakenly tries to prematurely reset or otherwise close the advanced circuit breaker before termination of an over-current or short-circuit condition.

For example, exemplary embodiments of the advanced circuit breaker 10 include those with maximum operational amperage ratings of between 100% and 135% of 25 to 150 amperes and interrupt ratings DC of 5,000 amperes. Other embodiments have other operation amperage ranges and interrupt ratings to protect electrical circuits having either direct or alternating current.

From the foregoing it will be appreciated that, although specific embodiments of the invention have been described herein for purposes of illustration, various modifications may be made without deviating from the spirit and scope of the invention. Accordingly, the invention is not limited except as by the appended claims.

It is claimed:

1. An electrical circuit breaker for protecting an electrical circuit, the electrical circuit breaker comprising:

a housing;

first and second electrical terminals affixed to the housing, the first and second electrical terminals configured to electrically couple the electrical circuit breaker to the electrical circuit;

a contact arm including first and second portions, the first portion electrically coupled to the first terminal and rotatably mounted within the housing, and the second portion having an arm contact affixed and electrically coupled thereto;

a cam including first and second portions, the first portion rotatably mounted within the housing, the second portion movably coupled to the contact arm such that rotation of the cam in a first rotational direction through a first amount of rotation causes rotation of the contact arm in a second rotational direction and further rotation of the cam in the first rotational direction through a second amount of rotation beyond the first amount of rotation causes rotation of the contact arm in a direction counter to the second rotational direction;

a torque generating member configured to apply a torque to the cam tending to rotate the cam in the first rotational direction; and a bimetal blade electrically coupled to the second electrical terminal, the bimetal blade configured to change shape based upon an amount of electrical current above a threshold level for at least a predetermined amount of time passing through the bimetal blade, the bimetal blade having a blade contact affixed and electrically coupled thereto, the bimetal blade shaped and positioned with respect to the contact arm such that the blade contact contacts the arm contact to prevent the contact arm from rotating in the second rotational direction when the amount of electrical current flowing through the bimetal blade is below the threshold level, the bimetal blade shaped and positioned with respect to the contact arm to allow the contact arm to rotate in the second rotational direction with the cam rotating in the first rotational direction through the first amount of rotation and to allow the arm contact to remain in contact with the blade contact when the amount of electrical current flowing through the bimetal blade increasingly exceeds the threshold level by up to a first amount of electrical current for at least a predetermined amount of time.

2. The electrical circuit breaker of claim 1, further comprising a conductive shaft electrically coupled to the first terminal and wherein the first portion of the contact arm is electrically coupled to the first terminal through the conductive shaft.

3. The electrical circuit breaker of claim 1, further comprising a camshaft rotatably mounted within the housing and wherein the cam is fixedly attached to the camshaft.

4. The electrical circuit breaker of claim 1 wherein the bimetal blade is further shaped and positioned with respect to the contact arm such that when the amount of electrical current flowing through the bimetal blade exceeds the first amount, the blade begins to snap to rapidly change shape and after further snapping motion, changes position with respect to the contact arm to cause the blade contact to stop contacting the arm contact and thereby allow the contact arm to rotate counter to the second rotational direction with the cam rotating in the first rotational direction through the second amount of rotation beyond the first amount of rotation.

5. The electrical circuit breaker of claim 1 wherein the first rotational direction of the cam is the same as the second rotational direction of the contact arm.

6. The electrical circuit breaker of claim 1, further comprising a breaker throw lever fixedly attached to the cam such that a torque applied to the breaker throw lever opposite and exceeding the generator induced torque applied to the cam will prevent the contact arm from rotating when the bimetal blade changes shape and position with respect to the contact arm as the electrical current through the bimetal blade exceeds the threshold level for at least a predetermined amount of time.

7. The electrical circuit breaker of claim 1 wherein the contact arm has first and second contact arm rails extending longitudinally away from the first portion of the contact arm and substantially parallel to one another, each of the first and second contact arm rails having a contact arm slot extending longitudinally within, the contact arm rails having a cam pin slidably retained thereto to movably connect the cam to the contact arm.

8. The electrical circuit breaker of claim 1 wherein the cam has first and second cam arms extending longitudinally away from the first portion of the cam and substantially parallel to one another, the first and second cam arms having a pin coupled thereto and extending therebetween, the cam having a roller so mounted on the pin to rollably engage the contact arm.

9. The electrical circuit breaker of claim 1 wherein the bimetal blade is configured and positioned to change shape and position with respect to the contact arm based upon the amount of electrical current passing through the bimetal blade above the threshold level for at least a predetermined amount of time and independent from rotational position of the cam.

10. The electrical circuit breaker of claim 1 wherein the bimetal blade is the shape of a Valverde blade.

11. The electrical circuit breaker of claim 1 wherein the bimetal blade is a snap disc.

12. The electrical circuit breaker of claim 1 wherein the contact arm is sized and positioned with respect to the bimetal blade such that the arm contact maintains substantial contact with the blade contact without electrical arcing occurring between the arm contact and the blade contact as the bimetal blade changes shape, including beginning to snap, and changes position with respect to the contact arm and as the cam rotates through the first amount of rotation.

13. The electrical circuit breaker of claim 1 wherein the threshold level results in a maximum operational amperage rating between 100% and 135% of 25 and 150 amperes for the electrical circuit breaker.

14. The electrical circuit breaker of claim 1 further comprising a conductive shaft electrically coupled to the first terminal and wherein the first portion of the contact arm is electrically and rotatably coupled to the conductive shaft.

15. The electrical circuit breaker of claim 14 further including an electrically conductive bearing lubricated with electrically conductive lubricant and configured to electrically and rotatably couple the first portion of the contact arm to the conductive shaft.

16. The electrical circuit breaker of claim 15 wherein the electrically conductive lubricant includes silver powder.

17. The electrical circuit breaker of claim 1 wherein the torque generating member is a spring shaped and positioned to apply a torque to the cam in the first rotational direction.

18. The electrical circuit breaker of claim 17 further including a camshaft having the cam rotatably mounted thereto, and wherein the spring is coupled to the cam.

19. The electrical circuit breaker of claim 17 wherein the spring is coupled to the cam.

20. The electrical circuit breaker of claim 17 wherein the spring has a coil portion.

21. The electrical circuit breaker of claim 1 further comprising a camshaft coupled to the housing and wherein the cam is rotatably mounted on the camshaft.

22. The electrical circuit breaker of claim 21, further comprising a breaker throw lever fixedly attached to the camshaft such that position of the breaker throw lever indicates whether the arm contact and blade contact are in contact with one another.

23. The electrical circuit breaker of claim 22 wherein the housing includes an internal containment area configured to contain the contact arm, the cam, the bimetal blade, and the torque generating member, and the housing includes a housing cover with an internal surface adjacent the internal containment area and an external surface opposite the internal surface, the breaker throw lever positioned adjacent the external surface.

24. The electrical circuit breaker of claim 23 wherein the housing cover includes an opening with the camshaft projecting therethrough and beyond the exterior surface of the housing cover and configured for attachment of the breaker throw lever thereto, and further including a seal positioned with respect to the camshaft, the breaker throw lever, and the opening of the housing cover to prevent fluids from entering into the internal containment area of the housing from areas adjacent to the external surface of the housing cover.

25. An electrical circuit breaker for protecting an electrical circuit, the electrical circuit breaker comprising:

a housing;

first and second electrical terminals configured to electrically couple the electrical circuit breaker to the electrical circuit;

a contact arm electrically coupled to the first electrical terminal, the contact arm rotatably mounted and having an arm contact electrically coupled thereto;

a current sensitive structure electrically coupled to the second electrical terminal, the current sensitive structure configured to change shape based upon amount of electrical current above a threshold level passing through the current sensitive structure for at least a predetermined amount of time, the current sensitive structure having a structure contact affixed and electrically coupled thereto, the current sensitive structure shaped and positioned with respect to the contact arm such that the structure contact touches the arm contact to maintain the contact arm in a first position when the amount of electrical current flowing through the current sensitive structure is below the threshold level, the current sensitive structure shaped and positioned with respect to the contact arm such that the current sensitive structure changes shape to cause the structure contact to maintain contact with the arm contact as the contact arm rotates in a rotational direction from the first position of the contact arm to a second position when the amount of electrical current flowing through the current sensitive structure exceeds the threshold level by at least a given amount above the threshold level for at least a predetermined amount of time; and a linkage coupled to the contact arm configured to apply rotational torque to the contact arm tending to rotate the contact arm in the rotational direction from the first position of the contact arm to the second position of the contact arm thereby following the direction of movement of the structure contact when the amount of electrical current flowing through the current sensitive structure exceeds the threshold level by at least the given amount for at least a predetermined amount of time, the linkage further configured to apply rotation torque to the contact arm tending to rotate the contact arm in a direction opposite the rotational direction when the contact arm reaches the second position thereby separating the structure contact from the arm contact when the amount of electrical current flowing through the current sensitive structure is at least the given amount above the threshold for at least a predetermined amount of time.

26. The electrical circuit breaker of claim 25 wherein the contact arm is rotatably coupled to a metal shaft.

27. The electrical circuit breaker of claim 25 wherein the current sensitive structure is shaped and positioned with respect to the contact arm such that the structure contact moves in a direction other than the direction opposite the rotational direction when the contact arm reaches the second position and the amount of electrical current flowing through the current sensitive structure is at least the given amount above the threshold for at least a predetermined amount of time.

28. An electrical circuit breaker for protecting an electrical circuit, the electrical circuit breaker comprising:

first and second electrical terminals configured to electrically couple the electrical circuit breaker to the electrical circuit;

a contact arm having an arm contact coupled thereto, the arm contact electrically coupled to the first electrical terminal, the contact arm configured to rotate about an axis from a first rotational position in a first rotational direction about the axis to a second rotational position and in a second rotational direction about the axis counter to the first rotational direction from the second rotational position to a third rotational position;

a linkage configured to be in a first linkage state or a second linkage state, the linkage so configured and coupled to the contact arm such that as the contact arm is between the first and second rotational positions, the linkage is in the first linkage state and as the contact arm is between the second and third rotational positions the linkage is in the second linkage state, the linkage so configured that in the first linkage state, the linkage applies a torque to the contact arm in a first rotational direction about the axis and in the second linkage state, the linkage applies a torque to the contact arm in a second rotational direction about the axis counter to the first rotation direction; and a bimetal blade electrically coupled to the second electrical terminal, the bimetal blade configured to change shape based upon amount of electrical current above a threshold level passing through the bimetal blade for at least a predetermined amount of time, the bimetal blade having a blade contact affixed and electrically coupled thereto, the bimetal blade shaped and positioned with respect to the contact arm such that the blade contact remains in contact with the arm contact to prevent the contact arm from rotating about the axis in the first rotational direction while in the first rotational position when the amount of electrical current flowing through the bimetal blade is below the threshold level, the bimetal blade further shaped and positioned with respect to the contact arm such that the bimetal blade changes shape to cause the blade contact to remain in contact with the arm contact as the electrical current passing through the bimetal blade exceeds the threshold level by at least a first amount for at least a predetermined amount of time and as the contact arm rotates in the first rotational direction from the first rotational position to the to the second rotational position, the bimetal blade shaped and positioned with respect to the contact arm such that the bimetal blade further changes shape to cause the blade contact to cease contact with the arm contact as electrical current passing through the bimetal blade exceeds the threshold level by at least a second amount for at least a predetermined amount of time and the contact arm moves in the second rotational direction from the second rotational position to the third rotational position.

29. The electrical circuit breaker of claim 28 wherein the linkage further comprises a spring.

30. An electrical circuit breaker for protecting an electrical circuit, the electrical circuit breaker comprising:

first and second electrical terminals configured to electrically couple the electrical circuit breaker to the electrical circuit;

a conductive shaft electrically coupled to the first electrical terminal;

a contact arm having first and second portions, the first portion electrically and rotatably coupled to the conductive shaft, the second portion having an arm contact affixed and electrically coupled thereto; and a bimetal blade electrically coupled to the second electrical terminal, the bimetal blade configured to change shape based upon amount above a threshold level of electrical current passing through the bimetal blade for at least a predetermined amount of time, the bimetal blade having a blade contact affixed and electrically coupled thereto, the bimetal blade shaped and positioned with respect to the contact arm such that the blade contact contacts the arm contact when the amount of electrical current passing through the bimetal blade is below the threshold level.

31. The electrical circuit breaker of claim 30, further including an electrically conductive bearing and electrically conductive lubricant configured to electrically and rotatably coupled the contact arm to the conductive shaft.

32. The electrical circuit breaker of claim 31 wherein the electrically conductive lubricant includes silver powder.

33. A method of operating an electrical circuit breaker, the method comprising:

coupling a spring to a linkage;

providing a rotatable contact arm having an arm contact coupled thereto and configured to rotate about an axis;

coupling the linkage to the rotatable contact arm;

applying force to the spring to tension the spring;

releasing the force applied to the tensioned spring to apply a first torque through the linkage in a first rotational direction about the axis to the rotatable contact arm;

providing a current sensitive structure configured to change shape based upon amount of electrical current flowing through the current sensitive structure above a threshold level for at least a predetermined amount of time;

positioning the current sensitive structure, having a structure contact coupled thereto, to contact the structure contact with the arm contact to prevent the rotatable contact arm from rotating in the first rotational direction from a first position; and flowing electrical current through the current sensitive structure above a threshold level for at least a predetermined amount of time to change the shape of the current sensitive structure to allow the rotatable contact arm to rotate in the first rotational direction from the first position to a second position while maintaining contact between the structure contact and the arm contact.

34. The method of claim 33, further comprising applying a second torque through the linkage in a second rotational direction to the contact arm once the contact arm reaches the second position to cease contact between the structure contact and the arm contact and to allow the contact arm to rotate in a second rotational direction about the axis counter to the first rotational direction from the second position to a third position, the structure contact and the arm contact remaining separated during rotation of the contact arm from the second position to the third position.

* * * * *